United States Patent [19]

Maloney, Jr. et al.

[11] 3,967,452

[45] July 6, 1976

[54] RAIN GUTTER AND DOWNSPOUT CONNECTION

[75] Inventors: John E. Maloney, Jr., Addison; Richard F. Zaccagni, Lombard, both of Ill.

[73] Assignee: ZMC, Inc., Addison, Ill.

[22] Filed: June 5, 1975

[21] Appl. No.: 584,149

Related U.S. Application Data

[62] Division of Ser. No. 341,519, March 15, 1973, Pat. No. 3,821,890.

[52] U.S. Cl. ..... 61/15; 52/16; 285/189; 285/404

[51] Int. Cl.[2] ..... F16L 21/00; E02B 9/04; E04D 13/08

[58] Field of Search ..... 61/15, 14; 52/16, 11, 52/12; 285/404, 424, 189

[56] References Cited

UNITED STATES PATENTS 190,382 5/1877 Snyder ..... 52/16

3,047,314 7/1962 Bean ..... 285/189 X

*Primary Examiner*—Jacob Shapiro

*Attorney, Agent, or Firm*—Hill, Gross, Simpson, Van Santen, Steadman, Chiara & Simpson

[57] ABSTRACT

A rain gutter has a bottom wall prepared for connection of a downspout thereto and comprising a downspout opening in the bottom wall having a continuous downturned lip flange around the edge of the opening derived from material displaced from the area of the opening, and extension means on the lip flange, whereby the extension means and the lip flange can engage within the upper end of a downspout to maintain the downspout in alignment with the opening. The lip flange provides a funnel-like closure for the joint between the gutter bottom wall and the upper end of a downspout coupled to the gutter by means of the extension means.

7 Claims, 8 Drawing Figures

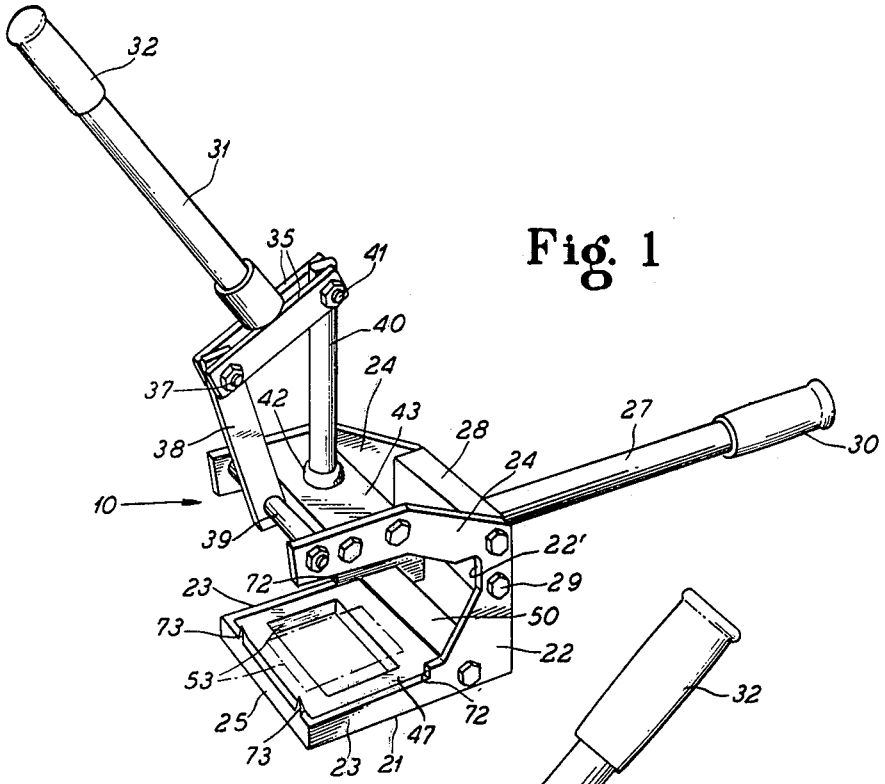
Fig. 1
Fig. 3
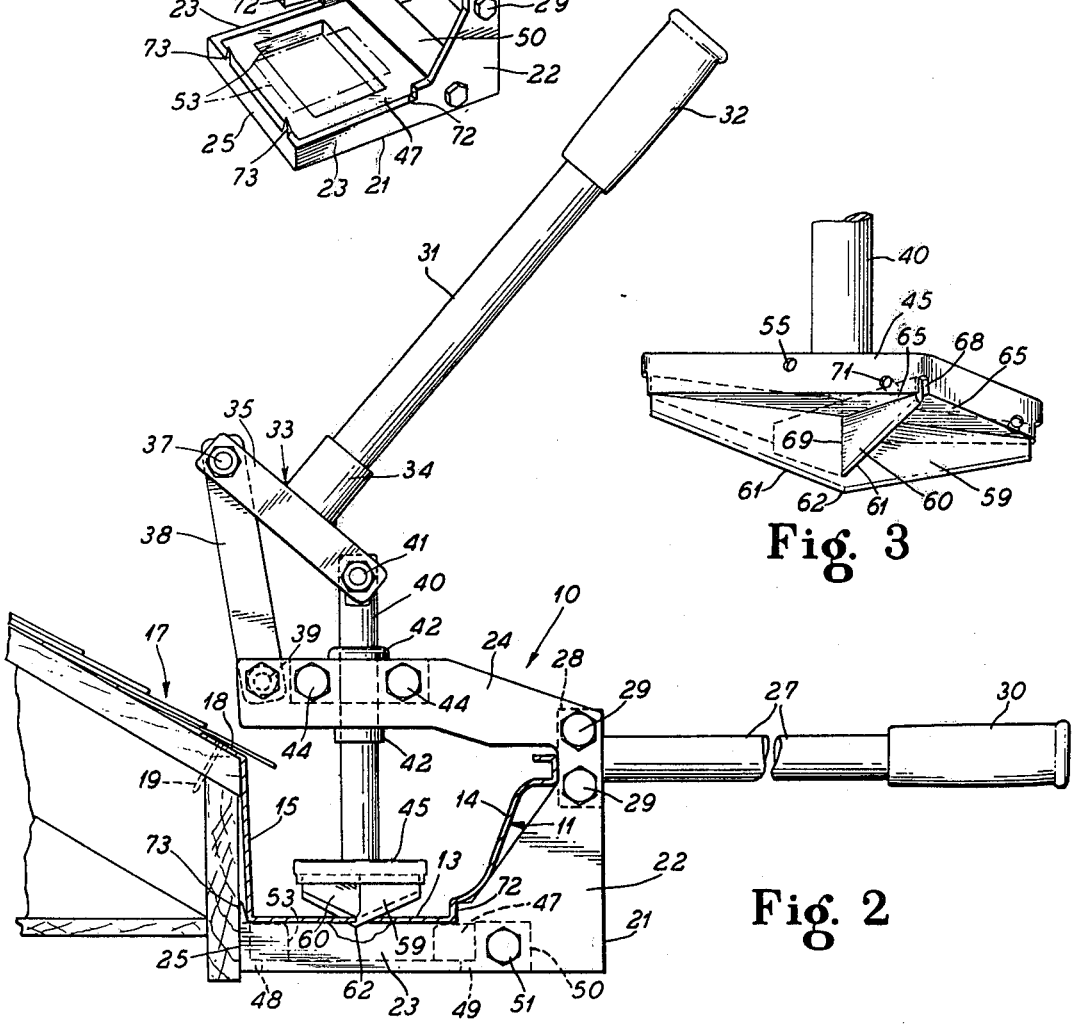
Fig. 2

Fig. 6
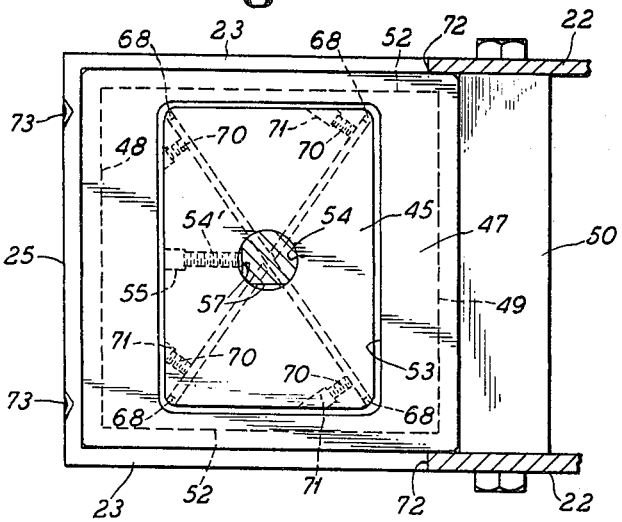
Fig. 7
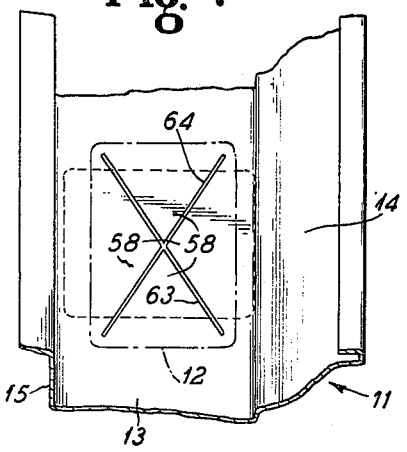
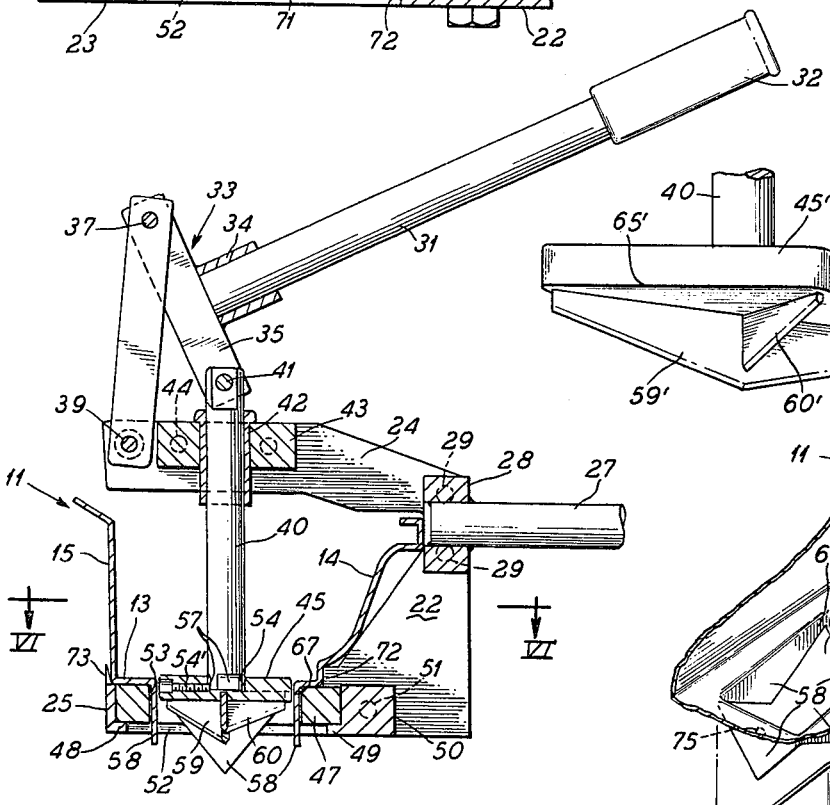
Fig. 5
Fig. 4
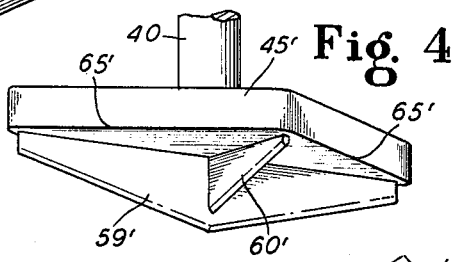
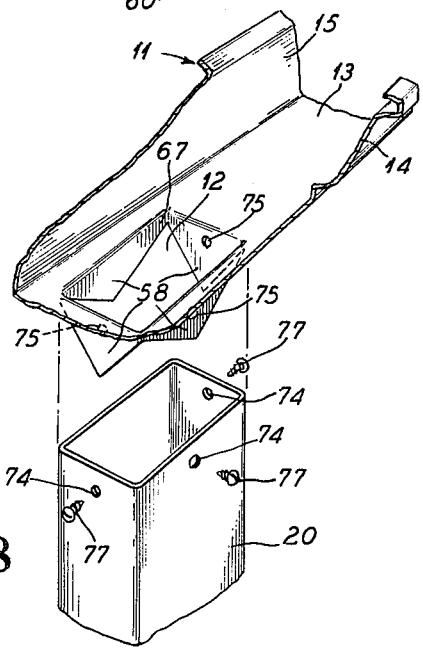
Fig. 8

RAIN GUTTER AND DOWNSPOUT CONNECTION

This is a division of application Ser. No. 341,519, filed Mar. 15, 1973 now U.S. Pat. No. 3,821,890.

This invention relates to the connection of downspouts to rain gutters, and is more particularly concerned with a new and improved method and a device for this purpose, and a rain gutter made thereby.

Connection of downspouts to rain gutters has heretofore presented problems which have not been satisfactorily met.

The most usual connection has consisted of a flanged insert in a hole punched in the bottom of the rain gutter and projecting downwardly therefrom to be received in the upper end of a downspout. With such inserts it is difficult to provide a leak-proof joint between the gutter bottom and the insert. In addition, the flange of the insert at the joint presents a raised rim around the opening into the insert on which various debris such as leaves, sticks, and the like, can catch, and in any event prevent complete drainage into the downspout so that weathering and deterioration are accelerated.

Some craftsmen have chisled, hacksawed or otherwise cut downspout holes and have bent the material into downward tabs to facilitate alignment of the upper end of a downspout and connection thereto. However, as thus produced, the holes have been rough in outline and the tabs of rather crude formation. Because of the relative difficulty of practicing this method, it has required a rather high degree of skill to produce a reasonably workman-like result, and has consumed more installation time and labor than warranted.

One attempt to solve the problem of excessive installation labor time has been to provide plastic downspout inserts which can be applied on the job site to prepunched downspout holes in the gutter bottoms. Such plastic inserts require sealing of the lip flange at the joint with the gutter bottom. Unless such sealing is expertly done, leaking of the joint is liable to be experienced. Further, there is a tendency for the workmen to apply the sealing material in a sloppy, haphazard manner aggravating the drainage obstruction about the downspout hole which is normally present due to the insert flange. Another disadvantage of this type of connection is that where the end of the downspout is not secured square onto the bottom of the gutter, so that a gap remains between the end of the downspout and the gutter bottom, sunshine into the plastic insert highlights the gap and leaves the impression that there is an opening in the joint which could permit leakage. Yet in most installations it is virtually impossible to secure square abutment of the end of the downspout with the bottom of the gutter.

Another and serious disadvantage of all prior expedients in effecting connection of downspouts with gutters has been that at least some part of the connection of necessity had to be prefabricated or preformed before hanging of the gutter. At least the downspout hole was preformed. This has all too often resulted in misalignment of the downspout relative to the necessity or desired vertical position for the downspouts such as along a reentrant corner or an outside corner of a building or along or between windows, or the like and especially where some vertical line of reference can be compared with the vertical disposition of the downspout. Such misalignment has been caused by either miscalculation or tolerances and variables in the preforming or prefabricating operations or in the installation of the gutter. In other words prefabrication according to plan or according to measurements taken at the building site may be inaccurate either as taken or as executed or fail to take into consideration a subsequent change in plan or construction. Therefore unless the variation is extreme, downspout installation is generally permitted to proceed even though there is inevitable misalignment or at least noticeable deviation from true alignment.

An important object of the present invention is to overcome the foregoing and other disadvantages, deficiencies, inefficiencies, shortcomings and problems in prior methods and structures, and to attain important new and improved devices, methods and structures in respect to the connection of downspouts with gutters, as will hereinafter become more clearly apparent.

Another object of the invention is to provide a new and improved device for preparing a rain gutter for connection of a downspout thereto.

A further object of the invention is to provide a new and improved device especially suitable for preparing a rain gutter for connection of a downspout thereto after the rain gutter has been hung in place on a building.

Still another object of the invention is to provide a new and improved method of preparing a rain gutter for connection of a downspout thereto.

Yet another object of the invention is to provide a new and improved method of providing rain gutters with downspout connections including in situ punching of downspout apertures after the gutters have been hung.

A still further object of the invention is to provide a new and improved connection for rain gutters with downspouts.

Other objects, features and advantages of the invention will be readily apparent from the following description of certain preferred embodiments thereof, taken in conjunction with the accompanying drawings although variations and modifications may be effected without departing from the spirit and scope of the novel concepts embodied in the disclosure, and in which:

FIG. 1 is a perspective view of a device embodying features of the invention.

FIG. 2 is a fragmental elevational and sectional view showing the device in use on a hung gutter.

FIG. 3 is a fragmentary elevational view of the male die of the device.

FIG. 4 is an elevational view similar to FIG. 3 but showing a modified construction of the male die.

FIG. 5 is a vertical sectional detail view through the device showing the relationship of the dies at the completion of the punching and shaping stroke in operation of the device.

FIG. 6 is a fragmentary sectional plan view taken substantially along the line VI—VI of FIG. 5, but with the gutter omitted.

FIG. 7 is a schematic illustration of steps in the method of forming a downspout connection in the gutter according to the present invention; and FIG. 8 is an exploded detail view demonstrating assembly of a downspout with a gutter provided with a downspout connection according to the present invention.

Important means for practicing the present invention comprise a device 10 (FIGS. 1 and 2) constructed and arranged to be applied to an eaves trough or rain gutter 11 to provide the gutter with a downspout drain hole 12 (FIGS. 7 and 8) in a flat bottom wall 13 of the gutter and from which bottom wall a front or outer wall 14 and a rear or inner wall 15 extend angularly generally upwardly. To facilitate hanging or the gutter at the eaves along the roof line of a building 17 (FIG. 2), the upper margin of the gutter back wall 15 may be provided with an angular attachment flange 18 adapted to be secured as by means of nails 19 to the edge of the roof under the lower preferably overhanging course of shingles.

Although the device 10 may be used to punch the hole 12 before the gutter 11 is hung, a preferred construction of the device permits it to be applied for punching the hole after the gutter has been hung. This has the great advantage that the hole can be precisely located in alignment with the preferred vertical location of a downspout 20 (FIG. 8) and will avoid misalignments that have heretofore been common according to conventional methods of assembly of downspouts with eaves troughs or gutters. To this end, the device 10 is provided with a light weight but rugged body 21 which may be constructed from a single piece of suitable heavy gauge steel plate shaped and bent into form or plate components welded together, but in any event comprising a pair of identical, coextensive side wall panels 22 which are shaped, as shown, generally of yoke configuration providing rearwardly opening mouth recess 22 for fully receiving the gutter 11 transversely therein and dimensioned to permit application of the device to a gutter by moving the device toward the outer side of the gutter. Thereby the side walls 22 have lower coextensive arms 23 which are constructed to underlie and receive the bottom wall 13 of the gutter, and upper arms 24 which are constructed to overlie the gutter in clearance relation. Along their rear ends the lower arms 23 are connected by a rear wall bar 25 which is preferably on the same height as the arms 23.

To facilitate handling the device 10, it is desirably provided with a handle 27 (FIGS. 1, 2, and 5) and which may be in the form of a suitable length of rod extending in a front to rear direction and secured as by means of welding centrally in a rigid frame bar 28 which extends between upper front portions of the side walls 22 and is secured rigidly thereto as by means of screws 29 on its outer end portion, the handle 27 may carry a rubber handgrip 30. Further assistance in manipulation of the device 10 is provided for by a second handle 31 which is desirably much the same as the handle 27 and carries on its outer end portion a rubber handgrip 32. Mounting of the handle 31 in a common front to rear vertical plane with the handle 27 is effected in a manner to enable the handle 31 not only to serve as means with the handle 27 for carrying and manipulating the device 10 as a whole, but also to serve as a die operating arm or lever. For this purpose the inner or proximal end of the handle 31 is secured rigidly to a power transmission cross arm 33 provided with a rigid hub 34 in which the inner end portion of the handle 31 is fixedly secured. Rigid with the hub 34 are spaced parallel coextensive cross arm bars 35 forming oppositely opening clevises. One of the clevises receives and is pivotally connected as by means of a bolt 37 to upper end of a link 38 forming part of the power transmission and which is secured pivotally at its lower end portion to a shaft 39 secured to and between the rear ends of the body arms 24. Thereby, rocking of the handle 31 about the pivot 37 transmits motion for vertical reciprocation of a die actuating plunger ram rod 40 having its upper end portion received between and pivotally connected as by means of a bolt 41 to and between the remaining clevis provided by the cross arm bars 35.

Vertical reciprocations of the ram rod 40 are guided by a bearing bushing 42 mounted centrally in a frame bar 43 secured to and between the upper or head arms 24 forwardly adjacent to the shaft 39 as by means of screws 44. The length of the ram rod 40 and its driving and return strokes are determined to carry a male die block 45 attached to its lower end between a fully retracted position where the die block is adjacent to or stopped against the lower end of the bushing 42, and a fully projected downward driving stroke position as shown in FIG. 5.

In its driving stroke, the die block 45 acts with a female die block 47 to punch the hole 12 in the gutter bottom 13. For this purpose, the die block 47 is firmly supported on a ledge 48 provided along the lower edge of the rear body bar 25, and a ledge 49 horizontally coplanar with the ledge 48 on the lower inner side of a rigid transverse frame bar 50 secured to and between the body panels 22 as by means of welding or screws 51. Desirably the lower arms 23 are provided with ledge extensions 52, extending to and between the ledge 48 and the ledge 49 (FIGS. 5 and 6).

For shaping the hole 12 to the desired configuration, the outline defined by the die block 45 and the outline of a die aperture 53 in the die block 47 are complementary and of sufficient differential in size to permit operating projection of the die block 45 into the aperture 53 while drawing flange material of the gutter therebetween. In this instance the die outline is of generally rectangular form elongated in one dimension to accommodate a currently popular downspout cross section. For some installations the hole 12 is desirably placed with its long dimension longitudinally relative to the gutter 11, as shown in dot dash outline in FIG. 7 and in full line in FIG. 8, but for other installations it may be desirable to have the long dimension of the hole 12 crosswise relative to the gutter as shown in dashed position in FIG. 7, mounting of the die member blocks 45 and 47 is such as to enable adjustment thereof to permit punching the hole 12 in either orientation of its long axis. Accordingly, the die block 47 is formed square in outside dimension and supported readily removably by the ledges 48, 49 and 52. Thereby the block 47 can be set with the long axis of the die aperture 53 in either of 90 degree selected orientations quickly as desired or necessary. To effect matching adjustment of the male die block 45, is is mounted on the ram rod 40 in a manner to permit quick release and reattachment of the block in selected 90 degree orientations. For this purpose, the lower end of the ram rod 40 is received in an upwardly opening mounting socket 54 centrally in the die block 45, with both the end of the rod 40 and the socket 54 of cylindrical shape to enable turning of the block relative to the rod for adjustment. Securing of the block 45 in the desired adjusted position is effected by means of a set screw 54 a threaded horizontally into the die block 45 through a tapped bore 55 and engaging at its inner end against a respective flat 57 on the perimeter of the socketed terminal portion of the ram rod. As will be observed in FIGS. 5 and 6, there are two of the flats 57 disposed in 90 degree orientation to permit attaining the desired adjustment.

By preference, the construction and relationship of the dies is such that not only is the downspout drain hole 12 punched in the bottom 12 of the gutter 11, but connection means are formed from the material struck from the hole. For this purpose, the die block 45 is equipped with means for so punching and cutting the material in the area of the hole that such material can be displaced to provide downspout locating and connecting tabs 58. To this end, the lower face of the die block 45 is provided with crossingly related cutting blades 59 and 60 of equal length extending between the respective diagonally opposite corners of the block. Respective downwardly projecting cutting edges 61 are provided on the blades 59 and 60 slanting from the opposite ends downwardly to converge at the center on the axis of the ram rod 40. To facilitate penetration of the sheet metal of the gutter bottom 13, the convergence of one of the blade edges 61, herein the blade 59 is at a point 62 located slightly lower than the convergence of the edge 61 of the blade 60. Thereby, in the punching stroke of the die 45, the point 62 will lead and easily penetrate the metal of the bottom 13 as shown in FIG. 2 and start a slit 63 (FIG. 7), with the blade 60 then following as penetration progresses to cut a slit 64 in the sheet metal.

Desirably, the length of the blades 59 and 60 is slightly less than the full dimension between the diagonal corners of the block 45 so that the ends of the slits 63 and 64 will terminate a predetermined distance from the eventual outline of the opening 12. Thereby upon driving of the die block 45 into the die aperture 53, drawing edges 65 on the die block 45 will uniformly draw a continuous narrow downwardly projecting lip flange 67 from the displaced material about the perimeter of the hole 12. The flange 67 is sized between the perimeter of the block 45 and the wall defining the die aperture 53, with the tabs 58 extending downwardly as extensions from the flange 67. It will be understood, of course, that the respective and relative length and perimeter outline as well as the length of relative telescoping stroke of the die block 45 and of the die wall 53 are such in relation to the gauge of the material of the gutter bottom 13 as to attain fairly accurate sizing of the downspout connection flange means provided by the flange 67 and the tabs 58. Slight normal springback will cause the tabs 58 to toe in slightly after completion of the flanging operation whereby to facilitate reception of the tabs within the upper end of the downspout pipe 20, although the outer perimeter of the downturned centering lip flange 67 will be dimensioned as close as practicable to conform with a sliding fit into the end of the downspout pipe.

In one desirable construction, the male cutting and punching die comprises an assembly wherein the die block 45 and the blades 59 and 60 are separately formed. In such an arrangement the die block 45 may be of a light weight material such as aluminum formed as a machined casting. On the other hand, the blades 59 and 60 may be formed from suitable cutting steel machined to shape, hardened, assembled with and secured to the die block. In one mode of construction, the blades 59 and 60 may be assembled with and permanently secured to the die block 45 during the casting process. In order to permit the blades 59 and 60 to be replaced or resharpened, the manner of assembling the same with the die block 45 as demonstrated in FIGS. 3, 5 and 6 may be employed, crossing blade-mounting slots or grooves 68 which extend between the opposite corners of the underface of the die block being provided for this purpose. The grooves 68 are of a width to receive the blades in close sliding fit, and the blades have coplanar straight back edges bottomed in the grooves. In order to permit the blades 59 and 60 to be mounted in crossing relation, the wider blade 59 has a central notch 69 extending partially therethrough from its back edge and aligned with the point 62 but stopping short thereof and of a length just great enough to receive the blade 60 therethrough in crossing relation to the blade 59 and with the back edges of the blades coplanar. Separable retention of the blades 59 and 60 in the slots 68 is by means comprising set screws 70 received in suitable tapped bores 71 which are formed to extend from the side edges of the block 45 adjacent to the opposite corners and on axes normal to the planes of the blades which are to be fastened by the set screws 70 driven threadedly into position.

In another desirable, simplified construction, as shown in FIG. 4, the male die block 45′ in all respects the same as described for the die block 45 of FIG. 3, is, however, constructed to provide the block and the blades 59′ and 60′ in one solid piece, being made as a casting of suitable material such hard aluminum or other suitable material. In this form, the integral, one piece solid die block and blades provide mutual reinforcement for one another, the blades being solidly backed up by the mass of the block, and the block being reinforced by the truss-like relationship of the blades to the underside of the block which encounters the force of the cutting and punching action of the die in use.

In use of the device 10, it is applied to the selected position along the length of the gutter member 11 while the punching die 45 is raised, that is, while the handle levers 27 and 31 are separated to their maximum extent, substantially as shown in FIG. 1. In the raised position of the die block 45, the device can be readily maneuvered to receive the front wall 14 of the gutter into the complementary cavity 22′ of the body 21, with a downward and rearward maneuver of the lower portion of the device placing the arms 23 and the rear frame bar 25 into position under the bottom wall of the gutter. Inasmuch as the hole 12 must be formed reasonably accurately in the bottom wall 13 whether the long axis of the hole is to be lengthwise of the gutter or is to be crosswise of the gutter, indexing means are desirably provided to assure proper positioning of the device relative to the bottom wall 13, and more particularly positioning of the dies 45 and 47, conveniently comprising indexing shoulders 72 on the side panels 22 at juncture with the arms 23, and indexing or locating upstanding respective tapered lugs 73 on the upper edge of the frame bar 25. Thereby the lower front corner portion of the gutter is engaged against the indexing shoulders 72 and the indexing lugs 73 assure that this will be done before the bottom wall 13 can seat properly on the arms 23 since the rear lower corner of the gutter must clear inside the lugs for this purpose. By having the lugs 73 tapered upwardly and outwardly, not only is reception of the gutter facilitated, but where the gutter is mounted rather snug against the facia of the building, the lugs 73 can push up behind the lower edge of the gutter back wall 15, as shown in FIG. 2. After the device has been maneuvered into position, it can be supported on the upper front edge of the gutter by resting the arms 24 thereagainst, but when the arm lever 31 is pulled down toward the arm lever 27, the die 45 driving against the bottom 13 will pull the arms 23 and thereby the die block 47 firmly up against the underside of the bottom 13, by virtue of the linkage transmission of the leverage force applied. Promptly after the hole 12 has been punched and the flange structure 58, 67 completed by action of the dies, the die block 45 is retracted, the slight spring-back of the material of the formed flanges of the gutter releases them from the die 47, and the device can be readily removed by a reverse maneuver to that which applied the device to the gutter.

To minimize weight in the device 10, it may be desirable to construct as many of its parts as practicable from light weight material of adequate strength. For example, instead of constructing the body frame 21 from steel parts, the entire frame including all cross bars thereof may be constructed as a one piece strong aluminum casting. The handle lever bars 27 and 31, as well as the ram rod 40 may be constructed from high strength aluminum tubing. The force transmission rocker bar and socket device 33 may be formed as an aluminum casting. The link 38 may be an aluminum bar. Where necessary bronze bearings may be provided, such as the bushing 42. Especially where the gutter 11 is made of aluminum strip. both the male die block 45 and female die block 47 may be made from hard aluminum. If a harder material is necessary at any wear points, bronze facing or inserts may be applied or suitable case hardening technique employed.

After the downspout drain hole 12 has been made and the connection flange structure 58, 67 completed, attachment of the downspout 20 to the connection may be effected in any preferred manner. For example after the upper end of the downspout 20 has been assembled with the connections 58, 67, at least opposite sides and if preferred, all accessible sides, of the downspout 20 are drilled to provide screw receiving holes 74 (FIG. 8) and the contiguous tab flanges 58 are drilled with screw holes 75 aligned with the holes 74. Such drilling is effected concurrently in all of the aligned screw holes after the downspout has been assembled with the downspout connection. After the holes have been drilled, respective sheet metal drive screws 77 are driven into the aligned holes to secure the downspout in place. Of course, the screws 77 are selected to be as short as practical to avoid undesirable obstructing projection into the downspout passage. It will be observed that the completed joint between the gutter and the downspout provides a smooth free flowing entry into the downspout drain opening 12, and the lip flange 67 assures a completely closed joint about the edge of the downspout pipe with freedon from leakage or spillover relative to the downspout, and freedom from any even appearance of loose joint since the opaque flange 67 effectively precludes seeing daylight through the joint even where the end of the downspout 20 may not be perfectly square against the bottom 13 of the gutter, provided that reasonable care in attaching the downspout to the downspout flange connection is exercised. Soldering, cementing or any other application of sealing material is unnecessary since the flange connection with the downspout at the downspout opening in effect funnels directly into the downspout.

It will be understood that variations and modifications may be effected without departing from the spirit and scope of the novel concepts of this invention.

We claim as our invention:

1. In a rain gutter formed from sheet material and having a flat bottom wall prepared for connection of a downspout thereto:

a downspout opening in said bottom wall having a continous downturned lip flange around the edge of the opening derived from material displaced from the area of the opening; and a plurality of depending attachment tabs at spaced intervals on said flange and also derived from the material displaced from said area;

said tabs having screw holes therethrough; whereby the lip flange and the tabs can be engaged within the upper end of a downspout and the downspout secured to the tabs by screws engaged in said screw holes and the bottom wall remaining solid and free from any other openings in the area about said downspout opening.

2. A rain gutter according to claim 1, in combination with a downspout having an upper end, said lip flange and tabs extending downwardly within the upper end of the downspout, and screws secured through holes in the downspout aligned with the holes in the tabs and thereby retaining the downspout in place on the gutter.

3. A rain gutter according to claim 1, in combination with a downspout having an upper end, said lip flange and the tabs extending downwardly within the upper end of the downspout, said lip flange and said upper end of the downspout being in sliding fit engagement, and screws secured through aligned holes in the downspout and said screw holes through the tabs, said lip flange extending to a sufficient length downwardly below said upper end of the downspout to provide a closure for the joint between the downspout upper end and the bottom wall of the gutter and effectively precluding seeing daylight through the joint even where the upper end of the downspout may not be perfectly square against the gutter bottom wall, said lip flange providing a funnel directly into the upper end of the downspout.

4. A rain gutter according to claim 1, wherein said downspout opening is of elongated generally rectangular shape, the long dimension of the opening extending lengthwise of the rain gutter.

5. A rain gutter according to claim 1, wherein said downspout opening is of elongated rectangular outline and having its long dimension extending across the bottom wall between angularly upwardly extending side walls of the gutter.

6. In a rain gutter according to claim 1, said opening being of generally rectangular form and said extension means tabs comprising respective generally triangular extensions from said flange extending downwardly from the portions of the continuous lip flange at the sides of the opening.

7. In a rain gutter according to claim 1, said tabs being toed in generally toward one another to facilitate reception thereof within the end of a downspout.

* * * * *